US005163271A

United States Patent [19]

Pan et al.

[11] Patent Number: 5,163,271

[45] Date of Patent: Nov. 17, 1992

[54] APPARATUS AND METHOD FOR MANUFACTURING COMPACT DISC HOLDERS

[75] Inventors: Peter N. Y. Pan, Minnetonka; Greg Fulkerson, Maple Plain; Stephen Kaye, Eden Prarie, all of Minn.

[73] Assignee: Thiele Engineering Company, Minneapolis, Minn.

[21] Appl. No.: 820,809

[22] Filed: Jan. 15, 1992

[51] Int. Cl.[5] ..... B65B 25/24; B65B 61/20

[52] U.S. Cl. ..... 53/468; 53/155; 53/238; 53/254; 53/474

[58] Field of Search ..... 53/474, 468, 157, 155, 53/254, 238, 240, 251, 250, 249, 234, 169; 206/313, 312, 309; 29/775, 773

[56] References Cited

U.S. PATENT DOCUMENTS

| | | | |
|---|---|---|---|
| 4,150,520 | 4/1979 | Palmieri et al. | 53/234 X |
| 4,551,966 | 11/1985 | Aoyagi et al. | 53/254 X |
| 4,685,277 | 8/1987 | Ilsemann | 53/254 X |
| 4,852,327 | 8/1989 | Kurkowski et al. | 53/254 X |
| 4,881,356 | 11/1989 | Beezer et al. | 53/238 X |

*Primary Examiner*—James F. Coan
*Attorney, Agent, or Firm*—Hugh D. Jaeger

[57] ABSTRACT

Fully automated apparatus and method for manufacturing compact disc holders having a central rotating table about which conveyor tables, rotary tables, placers and other devices align to interdigitate and load compact discs into disc bases, to mate disc bases containing CDs to packaging sleeves, to load booklets into the packaging sleeves, and to handle, glue, fold and otherwise form a package containing CDs and booklets or literature.

5 Claims, 4 Drawing Sheets

APPARATUS AND METHOD FOR MANUFACTURING COMPACT DISC HOLDERS

CROSS REFERENCES TO CO-PENDING APPLICATIONS

This application is related to U.S. Ser. No. 07/820,846, filed Jan. 15, 1992, entitled APPARATUS AND METHOD FOR ASSEMBLING COMPACT DISC OR MEDIA PACKAGE, assigned to the same assignee.

BACKGROUND OF THE INVENTION

1. Field of the Invention

This invention relates to apparatus for assembling a package to be used in displaying a compact disc or other media at a point of sale in stores, and for later storage in the home. The present invention also includes a process for assembly of the media package. Other media packages includes CD, ROMs, Optical ROMs, cassette tapes, laser discs or video tapes.

2. Description of the Prior Art

Compact discs ("CD") have become the medium of choice for recorded music. The compact discs have also presented packaging difficulties. A CD package has been needed which is large enough to provide adequate surface area for advertising in retail establishments, and which is large enough to discourage shoplifting.

The packaging must also be usable in the home or elsewhere for storage of the compact disc. Of course, the packaging for home storage is preferably no larger than needed to adequately store the compact disc.

In the prior art, this resulted in one storage package, such as a jewel box, for the home being overwrapped with additional disposable material to constitute the retail package. The hinged storage box is referred to as a jewel box and was usually a polymer of polystyrene which was very scratchable and very difficult to recycle. This large retail package and/or packaging was immediately thrown away by the customer, and then moved into the solid waste stream. CD packages were needed which could perform the two functions of retail display and home storage without immediately generating large amounts of solid waste. An additional problem is that the outside retail package was often made of non-biodegradable plastic and was not environmentally appropriate, especially to recycle.

The succeeding generation of compact disc packages was formed from a long rectangle of paper material, such as cardboard. A plastic compact disc holder was mounted to the cardboard. The cardboard and plastic holder had one configuration for store display and is known as Ecopak. After purchase, the customer reconfigured the plastic holder and folded the cardboard to reconfigure the package to a smaller size for home use. Therefore, none of the package was immediately thrown away. Additionally, the package could be made to employ more biodegradable paper products and olefin type polymers which are more easily recycled. This form of package posed new problems for compact disc loading on the CD package.

The present inventions is an apparatus which can quickly and efficiently assemble the plastic parts to the paper parts to create the modern style package configuration. As new formats of recording media are introduced, such as mini discs, this style of packaging will be adapted to the various sizes for CD, ROMs, laser discs, audio tapes and even video tapes.

SUMMARY OF THE INVENTION

The general purpose of the present invention is to provide an apparatus and method for manufacturing compact disc holders featuring a compact disc packager. A system of conveyor tables, rotary tables, placers and other devices align about a central table to handle, load, glue and otherwise process CDs, disc bases and sleeves into a single packaged item for subsequent sale, display and storage.

According to one embodiment of the present invention, there is provided a centrally located rotary table on a central table having a plurality of stations, two of which are input stations, one of which is a process station and the last of which is an off load station. Leading to one of the input stations is a disc base conveyor table including a disc base placer, a disc base opening mechanism, a placer and a rotary table. Another input station includes an aligned sleeve and literature conveyor table having on it a sleeve hopper, a placer, conveying trays and a glue system. A process station at one side of the rotary table includes a clip and reject station for severing the box end if required. The output station of the rotary table aligns to a central table including a main table conveyor, booklet placers, a sleeve folding mechanism, a pick and place mechanism and a discharge conveyor.

One significant aspect and feature of the present invention is a fully automated apparatus for manufacturing compact disc holders.

Another significant aspect and feature of the present invention is the use of a central rotary table having a plurality of stations to which input stations, process stations and off load stations align.

Another significant aspect and feature of the present invention is a sleeve and literature conveyor table aligned to a central rotary table for the purpose of placing sleeves on the central rotary table.

A further significant aspect and feature of the present invention is a disc base opening mechanism aligned to the flow of disc bases on the disc base conveyor table.

A still further significant aspect and feature of the present invention is a compact disc spindle table and servo controlled CD handling system for placement of CDs from the compact disc spindle table to disc bases moving along the disc base conveyor table.

Yet another significant aspect and feature of the present invention is a first rotary table aligned to the disc base conveyor table and central rotary table for placement of and transfer of compact disc trays with resident CDs from the first rotary table to a sleeve on the central rotary table.

Still another significant aspect and feature of the present invention is a clip and reject station on the central rotary table.

A still further significant aspect and feature of the present invention is an off load station on the central rotary table adjacent and aligned to the off load end of the central table where CDs in a disc base and attached sleeve are moved along the off load end where a pamphlet or booklet are placed in the package.

Another significant aspect and feature of the present invention is a table off load end having a sleeve folding mechanism and a reject chute.

Having thus described the embodiments of the present invention, it is a principal object hereof to provide a fully automated apparatus and method for manufacturing of compact disc holders.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
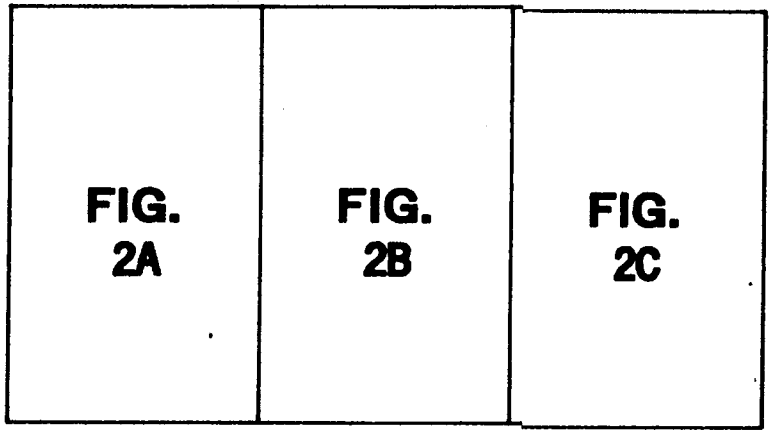
FIG. 1 illustrates the alignment of FIGS. 2A, 2B and 2C.
Figure 2A:
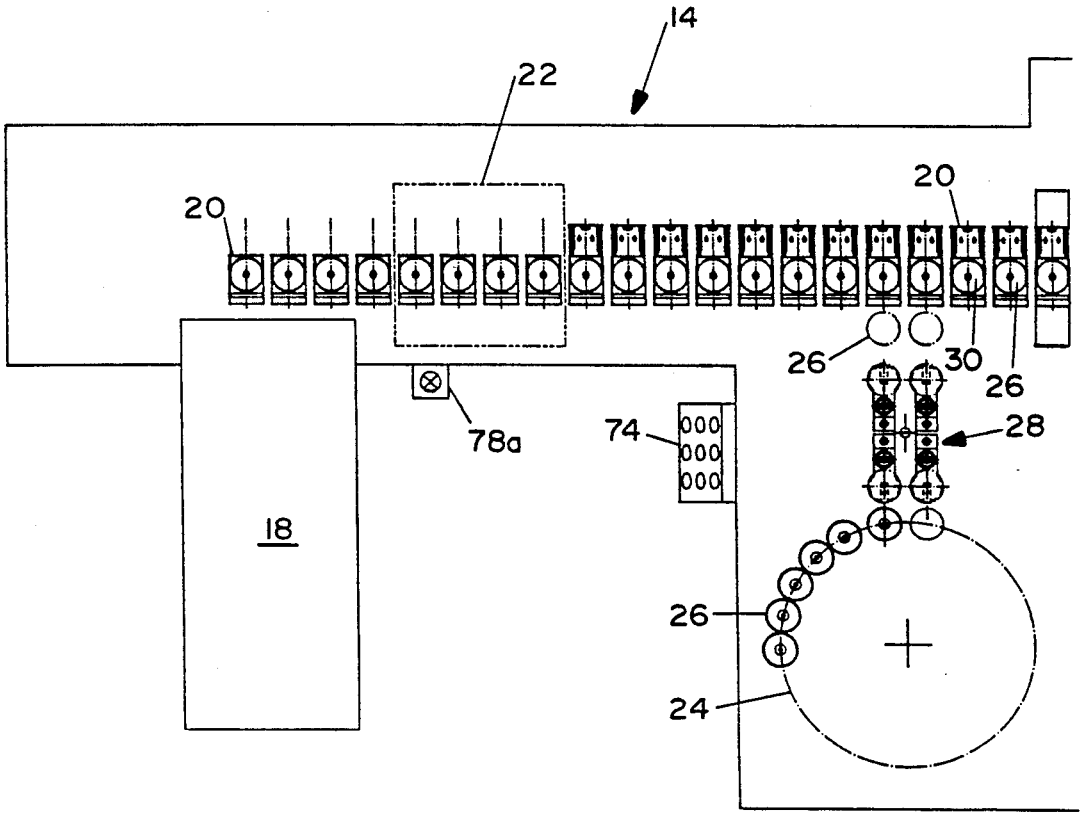
FIGS. 2A, 2B and 2C illustrate a plan view of a compact disc packager.
Figure 2B:
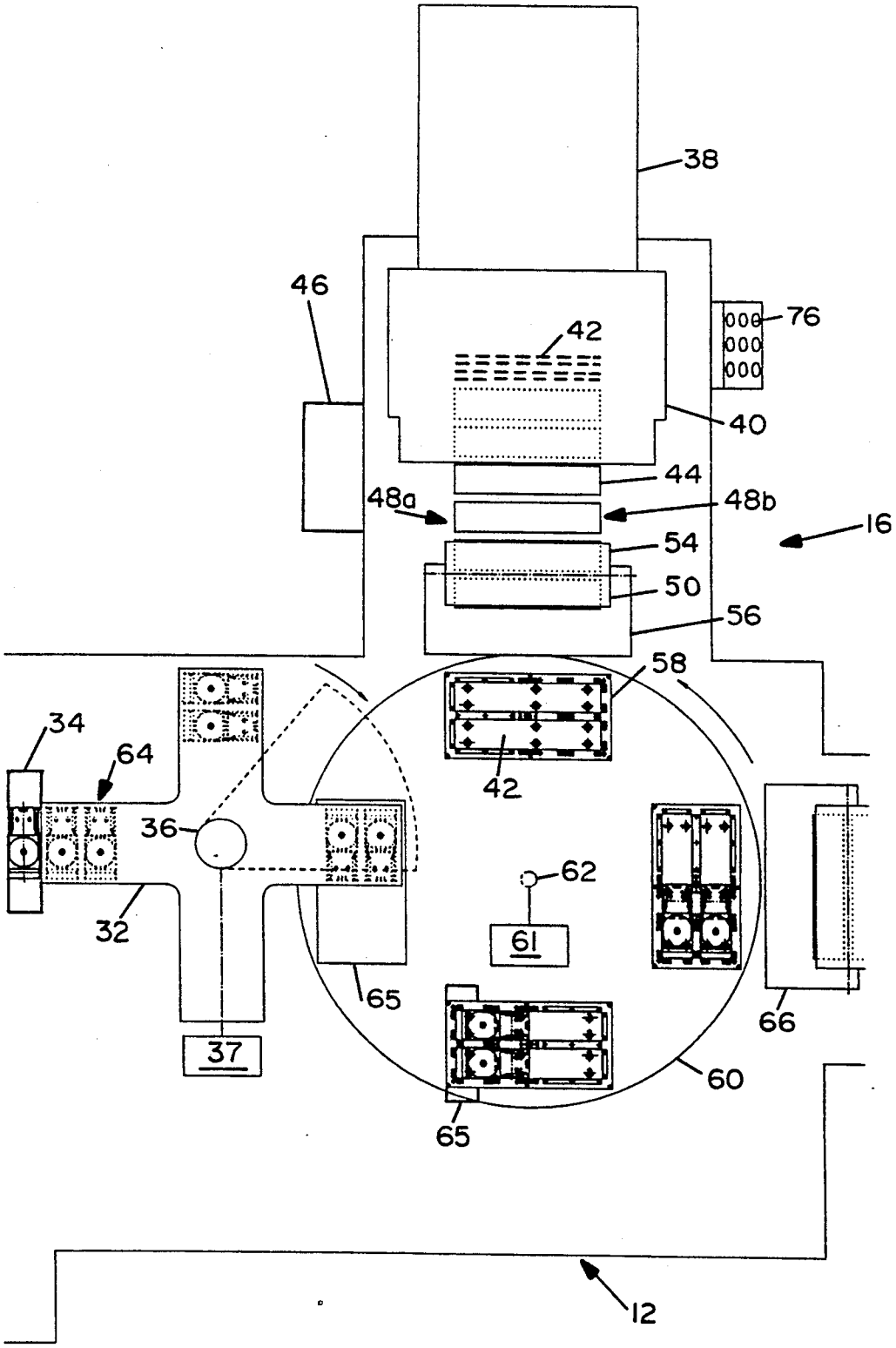
Figure 2C:
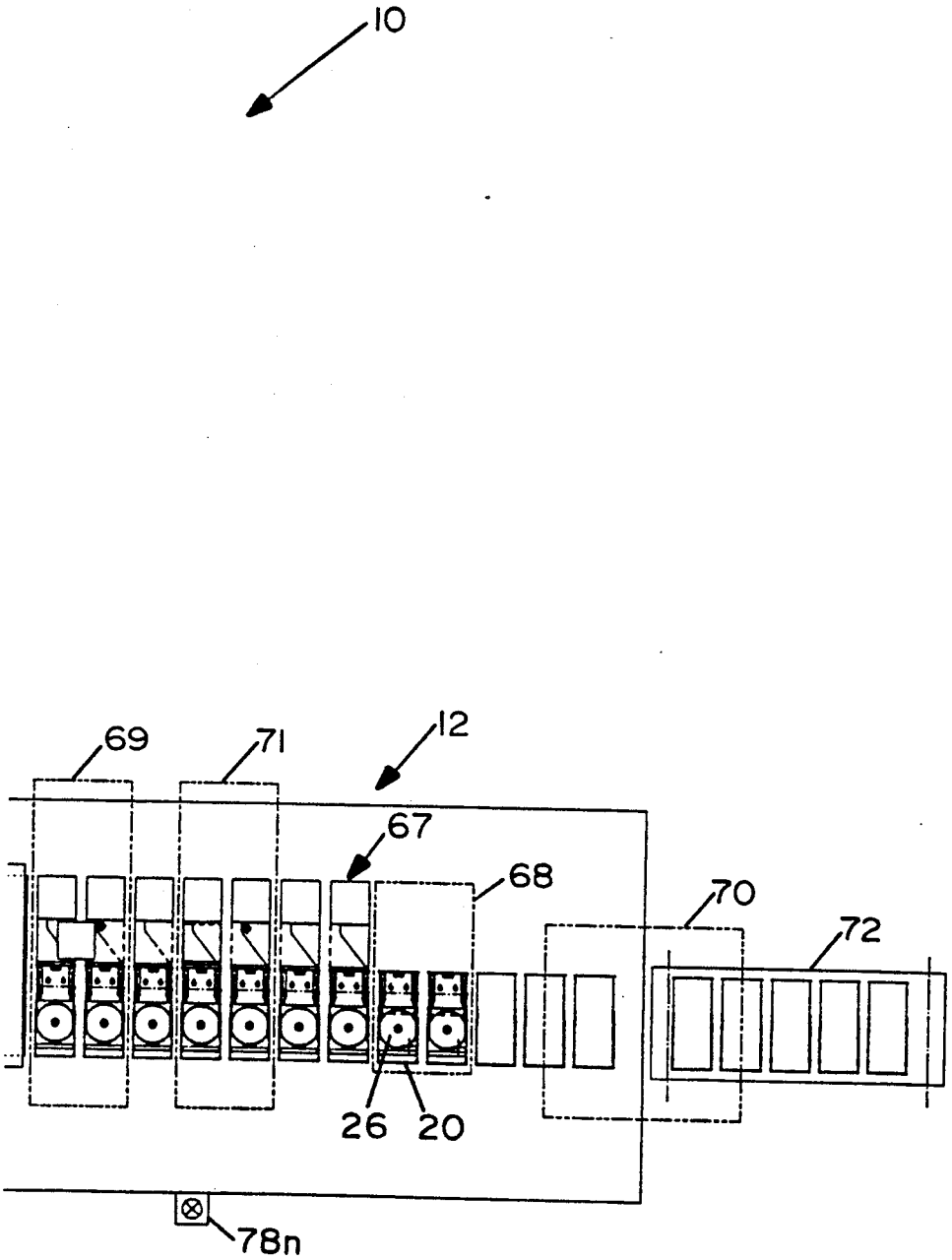

FIG. 1 illustrates the alignment of FIGS. 2A, 2B and 2C.

FIGS. 2A, 2B, and 2C illustrate a plan view of a compact disc or media packager 10, including processing components mounted and secured on a central table 12. A disc base conveyor table 14, and sleeve and literature conveyor table 16 align with the central table 12, preferably at right angles, for delivering compact discs (CDs), booklet literature and disc bases to the central table 12 for rapid packaging.

A disc base placer 18 aligns with and places plastic disc bases 20 on the disc base conveyor table 14, which are conveyed toward the central table 12. A disc base opening mechanism 22 aligns to open the disc bases 20 for subsequent accommodation of compact discs. A circular revolving compact disc spindle table 24 aligns a plurality of compact discs 26 on spindles with a servo controlled CD handling system 28 which places CDs 26, two or more at a time, into the circular cavities 30 of the opened disc bases 20. Plastic disc bases 20 with the compact discs 26 are conveyed on the disc base conveyor table 14 and placed on a first rotary table 32 in sets of at least two by a placer 34. First rotary table 32 is rotatably mounted on the central table 12, and pivots about a center 36 and is turned by a motor 37.

The sleeve and literature conveyor table 16 conveys assembled sleeves with booklets to the central table 12 for placement on the disc bases 20 containing the CDs 26. The sleeve and literature conveyor table 16 includes a sleeve hopper 38 and placer 40, which places sleeves 42 from the sleeve hopper 38 into conveyed trays 44. A glue system 46 applies glue through a plurality of orifices 48*a*–48*b* to appropriate surfaces of the sleeves 42. A rotary placer 50 places booklets from a friction feeder 54 on the glue-laden sleeve 42. The sleeves 42, with the glued on booklets, are conveyed to a placer 56 where they are placed two or more at a time into trays 58 on a central rotary table 60.

The central rotary table 60, powered by a motor 61, rotates about a center 62 and lies in a plane under the first rotary table 32 containing the semi-packaged CDs. A placer 64 on the under side of each arm of the rotary table places the CD disc bases 20, preferably in sets of at least two, onto the sleeves 42 in the trays 58 on the central rotary table 60.

A clip and reject station 65 aligns over the end of the CD trays as illustrated on the central rotary table 60. The clip and reject station 65 breaks end caps off of disc bases 20 in the case where the disc base 20 is molded with such removable end caps. Another placer 66 places the assembled disc base 20, the CD 26, and the sleeve 42 onto a main table conveyor 67. Booklet placers 69 and 71 place booklets into pouches in the sleeve 42. A sleeve folding mechanism 68 appropriately folds the remaining portion of the package over the CD 26 and the top of the disc base 20. A discharge pick and place conveyor 70 aligns at the end of the main table conveyor 67. A discharge pick and place conveyor 72 also aligns with the main table conveyor 67. Control panels 74 and 76 and a plurality of emergency stop switches 78*a*–78*n* are located at the strategic points of the compact disc packager 10.

Various modifications can be made to the present invention without departing from the apparent scope hereof.

We claim:

1. Apparatus for assembling compact disc packages comprising:

a. a central table;
b. a first generally circular table rotatably mounted on the central table;
c. a second generally circular table rotatably mounted on the central table in a slightly overlapping relationship with the first rotatable table;
d. a tray conveyor aligned for carrying compact disc trays to the central table;
e. placer means for moving compact disc bases from a disc base conveyor to the first table;
f. a sleeve conveyor for conveying CD album cover sleeves to the central table;
g. placer means for moving sleeves from the sleeve conveyor to the second table;
h. means to rotate the first table;
i. means to rotate the second table;
j. second placer means for moving compact disc bases from the first table and placing said bases on the sleeves on the second table; and,
k. discharge placer means for removing completed, assembled sleeves and disc bases from the second table.

2. The apparatus of claim 1 wherein the sleeve conveyor further includes:

a. gluing apparatus for applying glue to a portion of each sleeve; and,
b. placer means for placing literature on the glue to secure literature to each sleeve.

3. The apparatus of claim 1 wherein the first and second rotary tables rotate in opposite directions.

4. Method of assembling plastic compact disc holders comprising:

a. providing a compact disc base having two components slidable relative to each other;
b. opening the disc base;
c. loading a compact disc in the disc base;
d. providing a flat cardboard sleeve having distinct portions;
e. applying a glue to one portion;
f. mounting literature on the glue;
g. applying glue to a second portion;
h. mounting the disc base with compact disc on the glue on the second portion; and,
i. folding the sleeve over the disc base.

5. The process of claim 4 further comprising breaking a separable end cap from the compact disc base after it is glued to the sleeve.

* * * * *